US008585269B1

(12) United States Patent
Zincone et al.

(10) Patent No.: US 8,585,269 B1
(45) Date of Patent: Nov. 19, 2013

(54) HIGH EFFICIENCY LIGHTING FOR DEEP WELL SKYLIGHT WITH THERMAL BARRIER AND INTEGRAL CURB

(75) Inventors: Robert Zincone, Westport, CT (US); Richard W. Shriner, Jr., Darien, CT (US)

(73) Assignee: SunPort Industries, LLC, Norwalk, CT (US)

( * ) Notice: Subject to any disclaimer, the term of this patent is extended or adjusted under 35 U.S.C. 154(b) by 178 days.

(21) Appl. No.: 12/904,978

(22) Filed: Oct. 14, 2010

Related U.S. Application Data

(60) Provisional application No. 61/279,029, filed on Oct. 15, 2009.

(51) Int. Cl.
*E04D 13/03* (2006.01)

(52) U.S. Cl.
USPC ..... 362/576; 362/147; 362/253

(58) Field of Classification Search
USPC ..... 362/1, 576, 150, 147, 148, 180, 253
See application file for complete search history.

(56) References Cited

U.S. PATENT DOCUMENTS

| | | | | |
|---|---|---|---|---|
| 4,539,625 | A * | 9/1985 | Bornstein et al. | 362/576 |
| 5,528,471 | A | 6/1996 | Green | 362/147 |
| 7,057,821 | B2 | 6/2006 | Zincone | 259/595 |
| 2002/0085393 | A1 * | 7/2002 | Eisenman et al. | 362/576 |
| 2005/0201075 | A1 * | 9/2005 | Gandhi | 362/1 |
| 2006/0007549 | A1 * | 1/2006 | Zincone | 359/591 |
| 2010/0039799 | A1 * | 2/2010 | Levens | 362/147 |

* cited by examiner

*Primary Examiner* — Jong-Suk (James) Lee
*Assistant Examiner* — Leah S Macchiarolo
(74) *Attorney, Agent, or Firm* — Fattibene and Fattibene LLC; Paul A. Fattibene

(57) ABSTRACT

A skylight having a shaped reflector placed inside of the skylight adjacent a lamp for providing uniform natural and artificial lighting. The shaped reflector is positioned a predetermined vertical distance and a predetermined horizontal distance within the housing of the skylight to provide uniform artificial illumination simulating natural daylight illumination. Thermal efficiencies are improved with placement of a thermal barrier between upper and lower housings and external positioning of electrical ballast. Installation efficiencies are improved with the formation of an integral curb between the upper and lower housings.

8 Claims, 7 Drawing Sheets

HIGH EFFICIENCY LIGHTING FOR DEEP WELL SKYLIGHT WITH THERMAL BARRIER AND INTEGRAL CURB

RELATED APPLICATION

This application claims the benefit of U.S. Provisional Application No. 61/279,029, filed Oct. 15, 2009.

FIELD OF THE INVENTION

The present invention relates in general to improved skylights, and particularly to an energy efficient deep well skylight providing uniform day and night lighting that is thermally efficient and easy to install.

BACKGROUND OF THE INVENTION

Skylights or sky windows have often been used to illuminate the interior of buildings. Most skylights are passive devices that act as windows relying completely on natural daylight for illuminations. Some skylights have combined the benefits of natural lighting with artificial lighting. One such skylight is disclosed in U.S. Pat. No. 5,528,471 entitled "Skylight And Lamp Combination" issuing to Green on Jun. 18, 1996. Therein disclosed is a skylight and lamp combination for providing natural and artificial light to a room. A plurality of lamp fixtures is disposed within the housing of the skylight for emitting artificial light to the bottom end of the housing. The lamp fixtures are disclosed as being fluorescent light fixtures or incandescent light fixtures of conventional design. A retractable shade is also disclosed. For daytime darkening, the shade or blind is rolled over and the fluorescent lights are used alone or not depending on the shading needed during the day. Another skylight using artificial and natural lighting is disclosed in U.S. Pat. No. 7,057,821 entitled "Integrated Artificial and Natural Lighting System" issuing to Zincone on Jun. 6, 2006. Therein disclosed is a substantially self-contained and powered artificial and natural lighting system. Sensors detect illumination intensity to control the balance of natural and artificial light to maintain a predetermined illumination intensity.

While most skylights incorporating lamps or artificial lighting extend the practicality of skylights and their use for providing light when natural light is not available, they are often not as efficient as possible. Often the artificial light may be placed or positioned in a way that compromises the efficiency of the natural light or that provides artificial lighting that his harsh or substantially different than the natural lighting.

Additionally, skylights having deep wells are often thermally inefficient with substantial loss or gain of heat. Also, the installation of a skylight is often complicated and after installation is prone to leaking. Often special curbing or flashing is required to be manufactured on site adding to the time and cost of installation.

Therefore, there is a need for a more efficient skylight providing a natural and artificial lighting system that is easily installed, is energy efficient, and provides uniform lighting such that there is no perceived difference between the natural lighting and the artificial lighting.

SUMMARY OF THE INVENTION

The present invention is directed to an energy efficient deep well skylight that utilizes artificial lighting or fluorescent fixtures that maximizes fluorescent electric light performance while minimizing loss of daylight through the deep well skylight. The present invention results in a seamless light source making it difficult for the building occupants to distinguish between day lighting and artificial electric lighting. The placement and shape of a fluorescent or electrical fixture placed within the housing of the deep well skylight is optimized so as to provide uniform illumination, day or night.

A shaped reflector is used in combination with the artificial lighting or fluorescent lamps so as to provide uniform illumination. The shaped reflector has a curved horizontal artificial light reflector and an angled artificial light reflector placed a predetermined distance from the emerging light aperture and a predetermined distance laterally into the well of the skylight. A top natural light reflector is also used adjacent the shaped reflector.

An embodiment of the invention utilizes a thermal barrier so as to maximize the thermal insulation or "R" value of the deep well skylight. The thermal barrier, which may be a transparent sheet material, is placed in the plane of the thermal insulation of the roof.

In another embodiment of the invention, an integrated curb forms part of the deep well skylight housing or box, eliminating the need for separate curbs to be constructed or fabricated on site.

Accordingly, it is an object of the invention to provide an efficient skylight that provides a seamlessly transition from natural lighting to artificial lighting.

It is another object of the invention to maximize artificial light performance and minimize interference with natural lighting.

It is another object of the invention to improve the thermal efficiency of a skylight.

It is yet another object of the invention to make installation of a skylight easier and quicker.

It is an advantage of the present invention that uniform lighting is maintained with either natural or artificial lighting so that a user does not perceive a difference.

It is another advantage of the present invention that improved thermal insulation is obtained.

It is yet another advantage of the present invention that leaking after installation is substantially reduced or eliminated.

It is a feature of the invention that a shaped reflector is positioned a predetermined distance above an emerging aperture as a function of the size of the aperture.

It is a feature of the invention that a top natural light reflector is used minimizing the effect of the shaped reflector on natural lighting.

It is another feature of the invention that a thermal barrier is placed in the skylight in the plane of the thermal insulation in the ceiling.

It is yet another feature of the invention that an integral flange and curb is formed between an upper housing and a lower housing of the skylight.

These and other objects, advantages, and features will become readily apparent in view of the following detailed description.

DETAILED DESCRIPTION OF THE PREFERRED EMBODIMENTS

Figure 1:
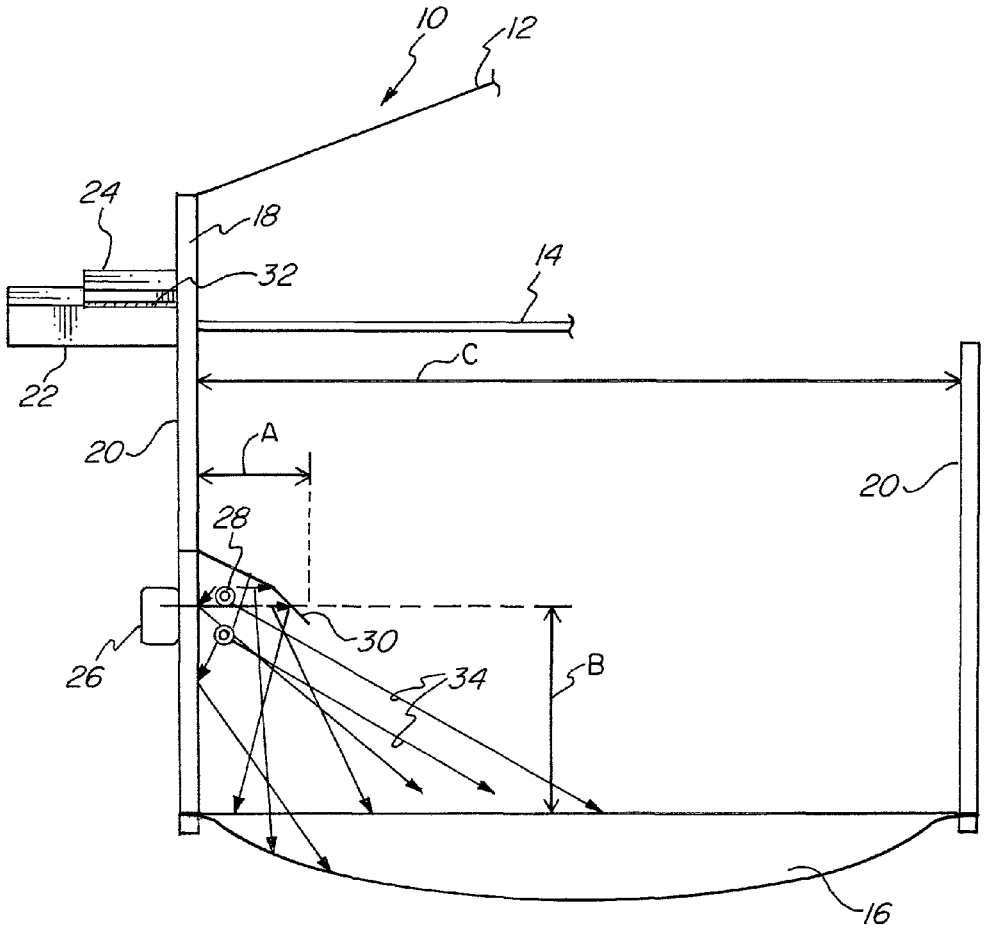
FIG. 1 schematically illustrates an embodiment of the invention.

FIG. 1 schematically illustrates a portion or section of the deep well skylight of the present invention. The deep well skylight assembly 10 comprises a window or dome 12 that is attached to an upper housing or curb 18. The upper housing or curb 18 extends to lower housing 20. An integral flange 32 separates the upper housing 18 from the lower housing 20. The integral flange 32 rests on top of the roof or ceiling 22 and is covered by roof insulation 24. Within the plane of the ceiling or roof 22, or any insulation formed or attached to the roof or ceiling 22, is placed a thermal barrier 14. The thermal barrier 14 may be a transparent sheet of plastic material and separates the deep well skylight housing or box into an upper housing 18 and a lower housing 20. The lower portion of the lower housing 20 is sealed with a lower lens 16 at the emerging aperture. The lower lens 16 is preferably a diffusion lens. Attached to the lower housing 20 is an artificial lighting or electric light fixture, and preferably a fluorescent light fixture. The fluorescent light fixture comprises a plurality of fluorescent lamps 28 that are powered by a ballast box 26 attached to the exterior surface of the lower housing 20. The ballast box 26 powers the lamps 28.

Adjacent to the fluorescent lamps 28 is a shaped reflector 30. The shaped reflector 30 has a compound shape. The electric light fixture is placed a vertical distance B from the emerging aperture or bottom of the lower housing 20 and extends a horizontal distance A into the interior space formed by the lower housing 20.

The overall design of the deep well skylight assembly 10 maximizes the artificial or electric light performance while minimizing the loss of daylight or natural lighting exiting the emerging aperture or lower lens 16. The design facilitates a seamless transition from daylight during the day to electric or artificial lighting during the night or when daylight is inadequate or not available to satisfy predetermined lighting needs. The dimensions A and B are optimized to provide maximum performance. The shaped reflector 30 has a compound shape that has been optimized by ray tracing to result in maximum illumination to be directed to the lower lens 16 in a unifoini pattern. Dimension B is optimized to deliver the maximum amount of light or illumination onto the lower lens 16. Dimension A, extending laterally or horizontally into the lower housing 20, is preferably made as small a possible to reduce any attenuation of daylight or natural lighting entering the window or dome 12 during the day. However, dimension A must be sufficiently large so as to uniformly deliver artificial light so as to provide a seamless transition from daylight or natural illumination to artificial illumination. Accordingly, the combination of dimensions A and B deliver an almost or substantially uniform diffused light or illumination pattern on to the lower lens 16 that nearly matches the diffusion pattern of daylight or natural lighting. The dimensions A and B are optimized as a function of the aperture C of the deep well skylight assembly 10.

As illustrated in FIG. 1, dimension A representing the distance the shaped reflector 30 extends laterally into the aperture C. Dimension A is approximately 11% of the aperture lateral dimension C. In a preferred embodiment, dimension A is approximately five inches and dimension C is approximately 45.88 inches. Therefore, the reflector extends laterally into the aperture approximately eleven percent of the aperture lateral dimension C. (5/45.88=0.11 or 11%)

The lamps 28 are placed approximately a vertical dimension B from the emerging aperture or lower lens 16. Dimension B is preferably substantially 27% of dimension C or the aperture of the skylight. In a preferred embodiment, dimension B is approximately 12.25 inches and dimension C is approximately 45.88 inches. Therefore, the lamps 28 are placed vertically from the lower lens 16 in the lower housing 20 of the deep well skylight assembly 10 approximately 26.7% of the aperture dimension C. (12.25/45.88=0.267 or 26.7%)

The combination of providing a lighting fixture that extends laterally into the aperture dimension C of the lower housing 20 a predetermined distance and positioning the lamps 28 of the lighting fixture a predetermined distance vertically from the lower lens 16 makes possible a constant even illumination irrespective of the source of the illumination being either natural daylight or artificial light. Arrows 34 represent light rays from the lamps 28 and reflected from the shaped reflector 30. As natural daylight is unavailable, the lamps 28 may be activated to supplement the natural daylight illumination or completely replace it with artificial light. Accordingly, the transition between natural daylight and artificial light is seamless, and the present invention provides substantially even uniform illumination.

The specific dimensions A and B, relative to or as a function of the dimension C have been found to permit the creation of artificial light that simulates natural daylight from the deep well skylight. Therefore the look, feel, and effect of the lighting are the same day or night or whether artificial or natural light is providing illumination. This makes the use of natural lighting much more practical and desirable, in that it assures that irrespective of the availability of natural lighting a consistent and uniform illumination is always obtained.

The present invention also provides an arraignment to improve the thermal characteristics of a deep well skylight. The ballast box 26 is located external to the lower housing 20 so that heat generated by the ballast box 26 is not generated within the interior of the deep well skylight assembly 10. This also provides easy maintenance and access to the ballast box 26. Additionally, the ballast box 26 will not interfere with light throughput within the interior of the deep well skylight assembly 10.

Additionally, the position of the thermal barrier 14 being in the same plane as the thermal insulation of the roof or ceiling 22 maximizes the thermal insulation, or "R", value. By placing the thermal barrier 14 in the same plane as the roof insulation or ceiling it forces any heat transfer into the upper air chamber within the upper housing 18. If the thermal barrier 14 is placed above the roof insulation adjacent to ceiling 22, there will be a thermal transfer into the lower chamber formed by the lower housing 20 and the thermal barrier 14 which would lower the insulating properties of the deep well skylight, or overall "R" value.

Figure 2:
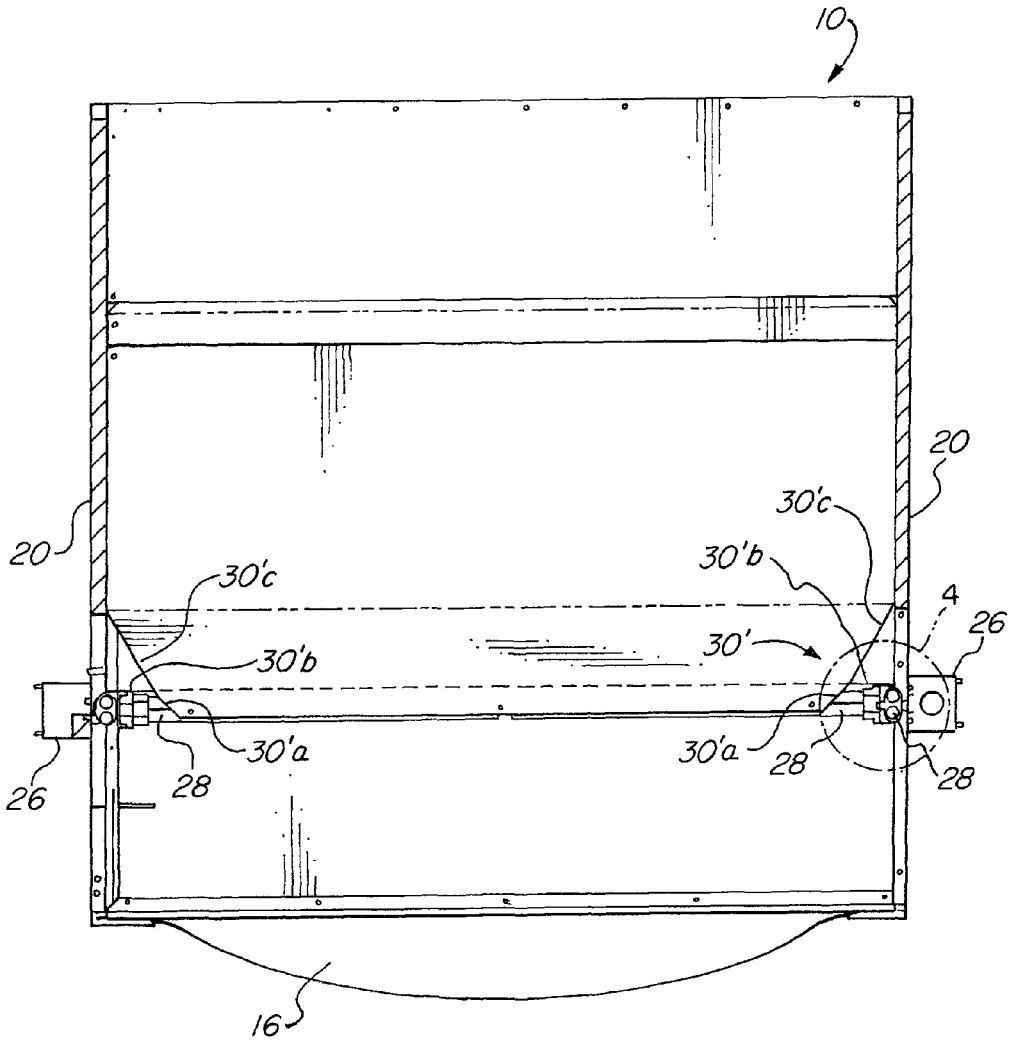
FIG. 2 is an elevational view of an embodiment of the invention.
Figure 3:
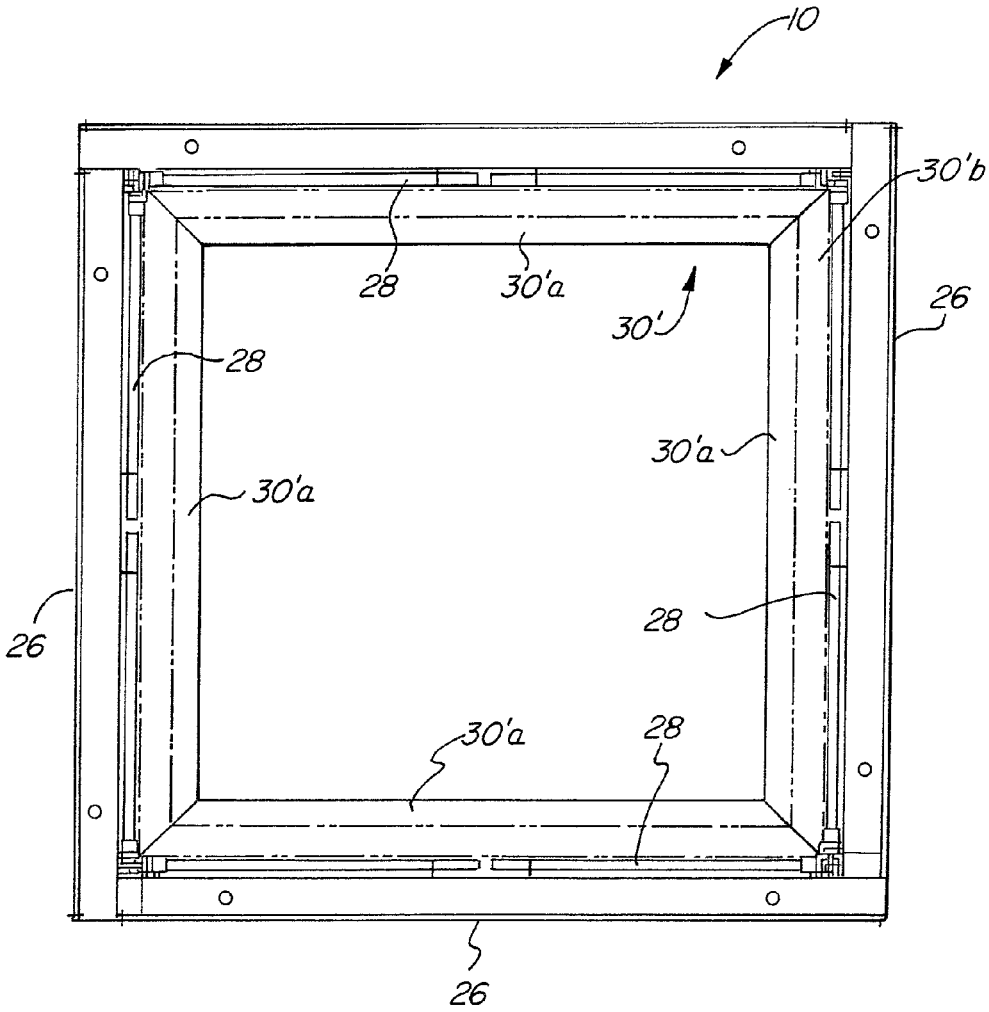
FIG. 3 is a bottom view of the embodiment of the invention illustrated in FIG. 2.
Figure 4:
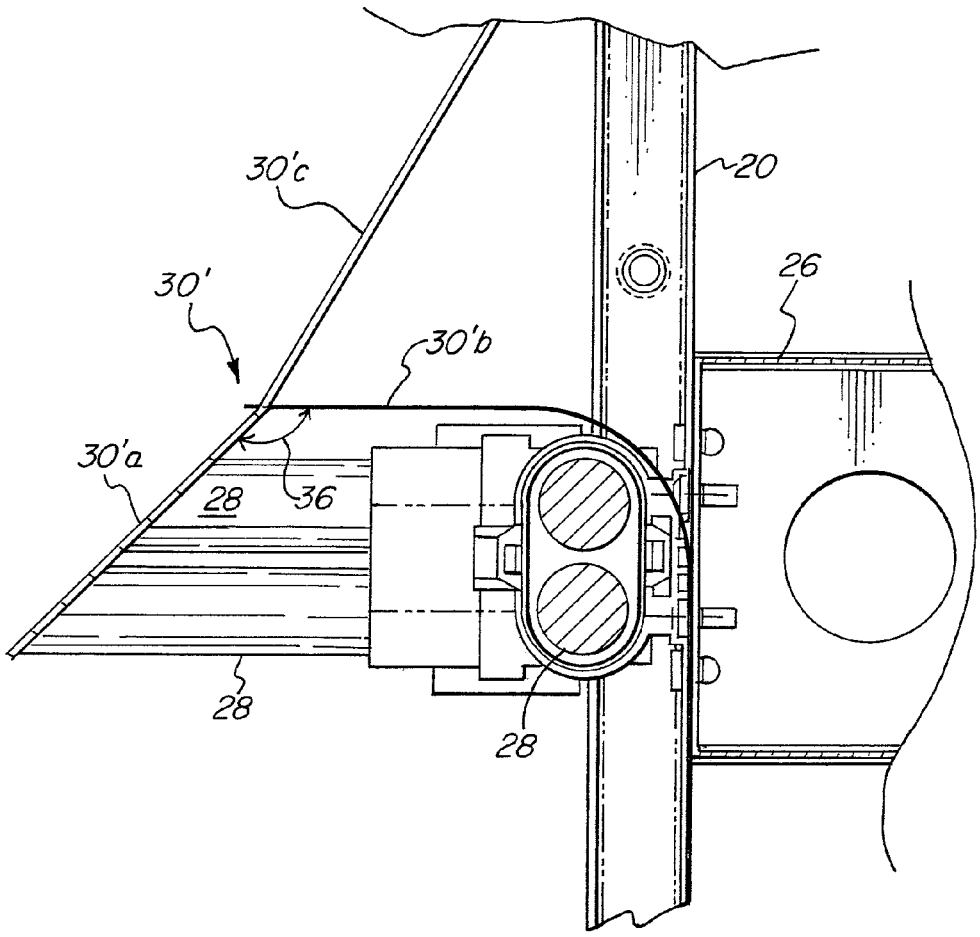
FIG. 4 is an enlarged view of circle 4 illustrated in FIG. 2.

FIGS. 2-4 illustrate features of an embodiment of the invention in greater detail. FIGS. 2-4 illustrate the shape and dimensions of a slightly modified shaped reflector 30' incorporated into a deep well skylight assembly 10. The reflector is preferably comprised of a radius section and two linear sections formed at a predetermined angle 36, illustrated in FIG. 4. The predetermined angle 36 is preferably substantially one hundred and thirty five degrees. Attached to the lower housing 20 is a modified shaped reflector 30'. The modified shaped reflector 30' has an angled artificial light reflector **30'*a*** attached to a curved horizontal artificial light reflector 30'*b*. The curved horizontal artificial light reflector 30'*b* has a linier horizontal portion and a curved portion adjacent lamp 28. A top natural light reflector 30'*c* extends from the angled artificial light reflector 30'*a* from one end and attaches to the lower housing 20 at the other end. The top natural light reflector helps to direct natural light through the emerging aperture towards lower lens 16 and minimizes any interference or shadowing that could result from the modified shaped reflector 30'.

Figure 5:
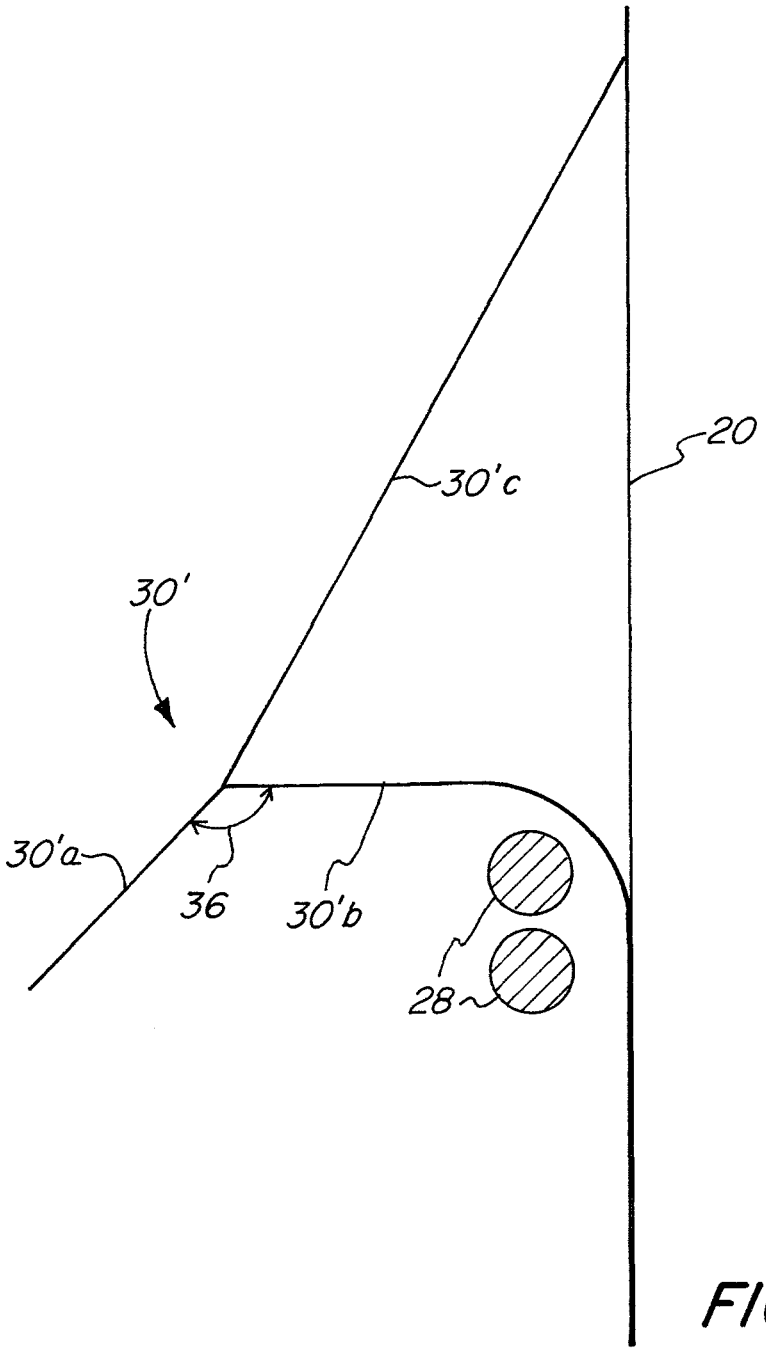
FIG. 5 is a schematic of the shaped reflector.

FIG. 5 schematically illustrates more clearly the arrangement of the modified shaped reflector 30'. The shaped reflector 30' is attached to the lower housing 20 and extends into the skylight well. The shaped reflector 30' includes a curved horizontal artificial light reflector 30'*b* having a curved portion adjacent the fluorescent lamps 28 and a linear horizontal portion attached to an angled artificial light reflector 30'*a*. Angle 36 is preferably 135 degrees. A top natural light reflector 30'*c* extends from an end of the angled artificial light reflector 30'*a* to the lower housing 20. The configuration of the shaped reflector 30' makes possible efficient redirection of the illumination from the lamp 28 and minimizing the obstruction of the natural light entering the skylight and emerging at the lower lens 16, illustrated in FIGS. 1 and 2.

Figure 6:
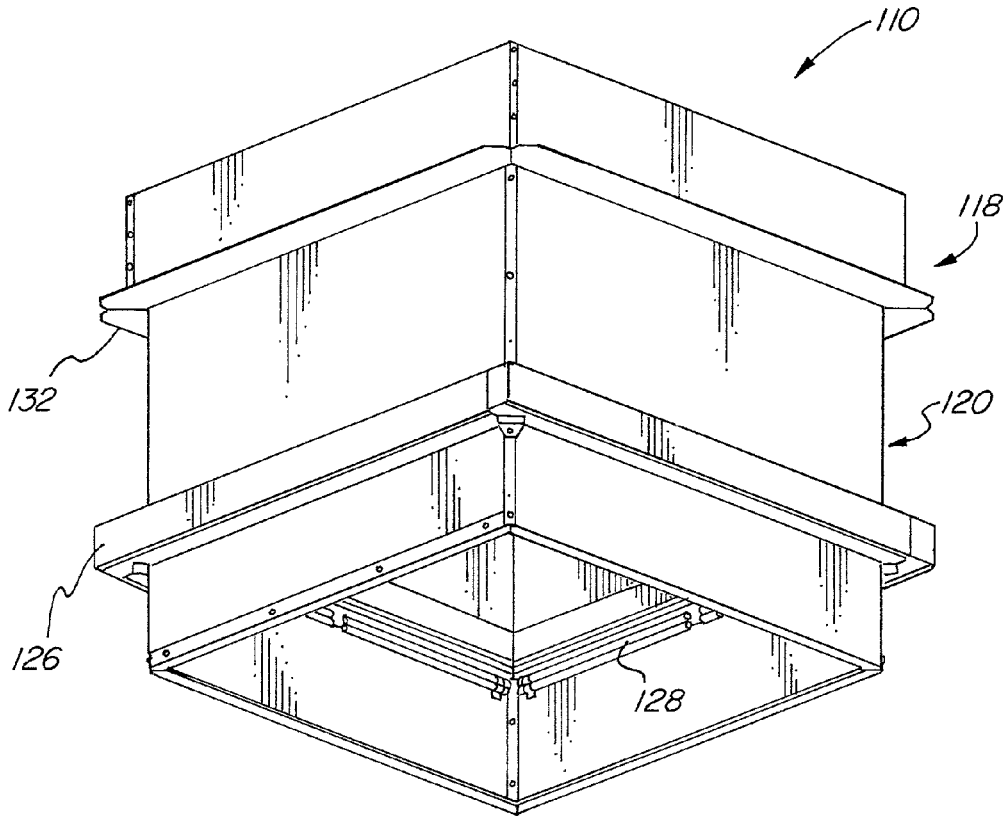
FIG. 6 is a perspective view illustrating a deep well skylight housing or box with an integral curb.

FIG. 6 illustrates an embodiment of the present invention utilizing a deep well skylight housing or box 110 that has an integral curb 118. An integral flange 132 separates the deep well skylight housing or box 110 into an upper housing or curb 118 and a lower housing 120. The ballast in the ballast housing 126 powers the lamps 128, which are placed in the interior of the deep well skylight box or housing 110. The deep well skylight box or housing 110 is preferably made of galvanized steel or other suitable metal material that may come in four panel sections that are bolted together to form a box. The integral curb 118 is formed as part of the deep well skylight box or housing 110. The integral curb 118 typically extends above a roof line. The integral curb 118 preferably has a thickness of approximately 1" to 1.5" so that a deep well skylight window or dome may be mounted thereon. Accordingly, the deep well skylight box or housing 110, having the internal curb 118, may be easily dropped into a cut out opening of a roof without the need for building up a separate wooden curb. This saves time in the installation and provides for an improved installation that may not readily leak. Additionally the curbing 118 may be insulated to improve thermal properties of the installed deep well skylight.

Figure 7:
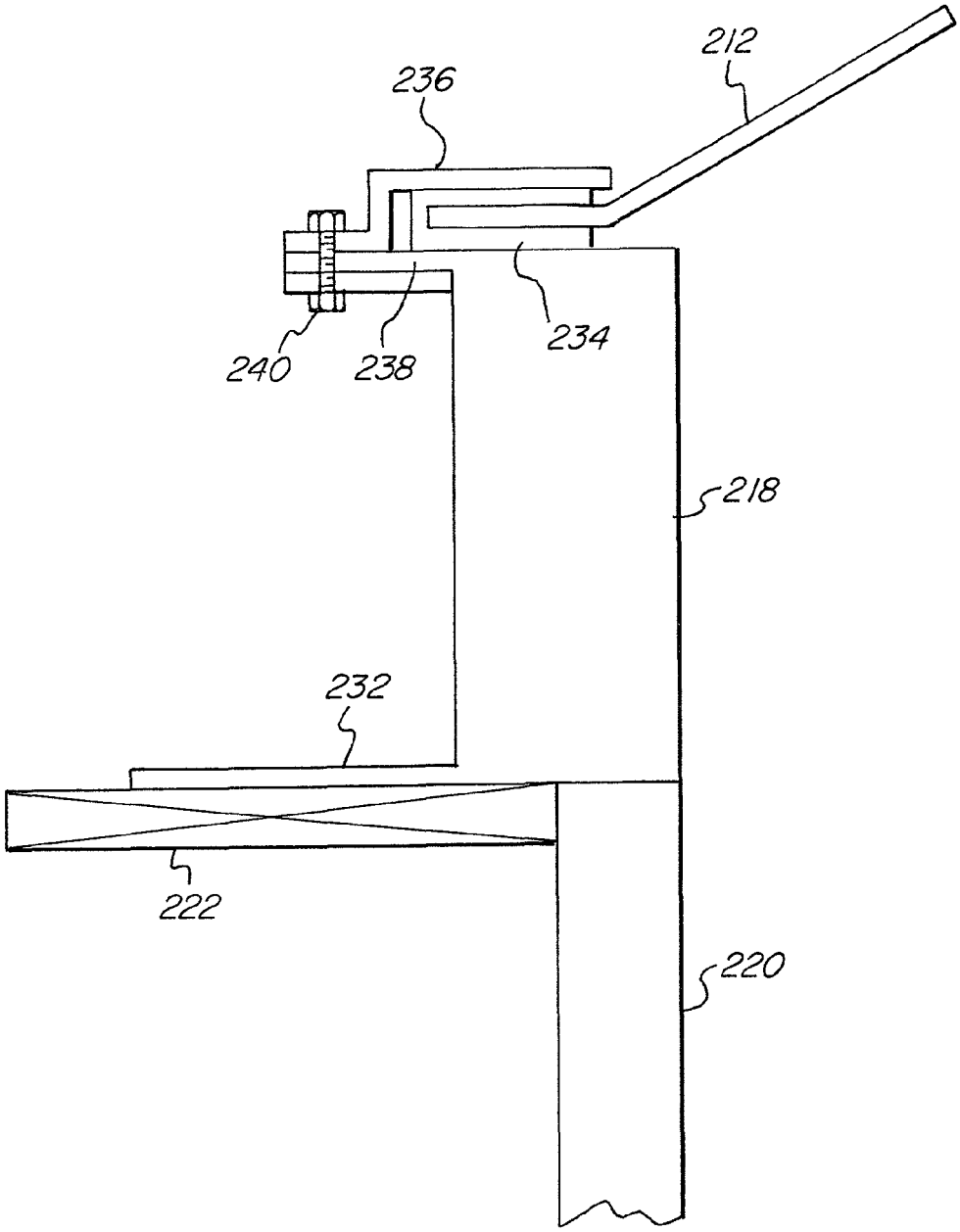
FIG. 7 schematically illustrates means for attaching a deep well skylight window or dome to a deep well skylight housing or box.

FIG. 7 illustrates a structure for installing a deep well skylight window or dome 212 onto an upper housing or curb 218 of a deep well skylight assembly. The lower housing 220 of a deep well skylight box or housing is attached or formed integrally with an upper housing or integral curb 218 that has an integral flange 232 adapted to rest on the surface of a roof or ceiling 222. A flange 238 extends from the top surface of the upper housing or integral curb 218. The flange 238 and the top surface of the upper housing or integral curb 218 form a flat surface for mounting the transparent window or dome 212 of the deep well skylight. A U-shaped seal 234 wraps around a flat portion of the window or dome 212 around the entire perimeter thereof. A pressure plate 236 is placed over the U-shaped seal 234 and forms a water tight seal between the pressure plate 236 and a top surface of the flange 238 and the upper housing or integral curb 218. A bolt 240 extends through a portion of the pressure plate 236 and the flange 238 to securely hold the pressure plate 236 against the U-shaped seal 234 sealing the entire perimeter of the deep well skylight window or dome 212. Accordingly, a very secure seal is established, preventing the possibility of any leakage.

This invention provides a shaped reflector that produces an artificial light distribution that is the same as the natural light distribution so that a user perceived no difference in artificial or natural light. This is highly desirable from a human factor working environment perspective. The horizontal and vertical positioning of the shaped reflector within the skylight is designed to maximize the lumen or illumination of the artificial light with minimal impact on the delivery of natural light. The shaped reflector provides illumination to the lower lens that substantially matches natural light delivered to the lower lens during daylight hours. The top natural light reflector is designed to minimize upward reflection or bounce from natural day lighting illumination. Therefore, the invention provides an efficient skylight providing uniform artificial and natural lighting that is easy to install and saves energy.

While various embodiments have been illustrated and described, it should be appreciated that various modifications may be made to the illustrated preferred embodiments without departing from the spirit and scope of this invention.

What is claimed is:

1. A skylight for placement in a roof of a building for providing uniform illumination of natural and artificial light comprising:

an upper housing;

a lower housing having an aperture with a lateral dimension;

a lower lens;

a shaped reflector having a compound shape attached to said lower housing at a first predetermined distance above said lower lens and extending a second predetermined distance laterally into said lower housing;

said shaped reflector comprises a curved horizontal artificial light reflector and an intersecting linear angled artificial light reflector having a top portion above the curved horizontal artificial light reflector and a lower portion below the curved horizontal artificial light reflector;

wherein said first and second predetermined distances are selected to provide uniform artificial light illumination simulating natural lighting from the skylight; and an artificial light source placed adjacent said shaped reflector, whereby natural or artificial light can be provided having the same uniform illumination appearance.

2. A skylight for providing uniform illumination of natural and artificial light as in claim 1 wherein:

an angle between the curved horizontal artificial light reflector and the lower portion of the intersecting linear angled artificial light reflector is substantially one-hundred and thirty five degrees.

3. A skylight for providing uniform illumination of natural and artificial light as in claim 1 wherein:

the first predetermined distance is equal to substantially twenty seven percent of the lateral dimensions of the aperture.

4. A skylight for providing uniform illumination of natural and artificial light as in claim 1 wherein:

the second predetermined distance is equal to substantially eleven percent of the lateral dimension of the aperture.

5. A skylight for providing uniform illumination of natural and artificial light as in claim 1 wherein:

said artificial light comprises a fluorescent lamp.

6. A skylight for providing uniform illumination of natural and artificial light as in claim 1 further comprising:

a thermal barrier placed adjacent the upper housing in a plane with the roof or ceiling.

7. A skylight for providing uniform illumination of natural and artificial light as in claim 1 further comprising:

an integral flange placed between said upper housing and said lower housing, whereby said integral flange contacts the roof of the building when the skylight is paced in an opening.

8. A skylight for providing uniform illumination of natural and artificial light as in claim 1 further comprising:

a ballast housing attached to an outside surface of said lower housing.

* * * * *